United States Patent [19]

Kubo et al.

[11] Patent Number: 4,751,335

[45] Date of Patent: Jun. 14, 1988

[54] PROCESS FOR PREPARING A FLUID FOR TRACTION DRIVE

[75] Inventors: Junichi Kubo, Yokohama; Kenji Suzuki, Tokyo; Kozo Kamiya, Kamakura; Eiji Akiyama, Odawara; Masao Nambu, Yokohama, all of Japan

[73] Assignee: Nippon Oil Co., Ltd., Tokyo, Japan

[21] Appl. No.: 9,833

[22] Filed: Feb. 2, 1987

[30] Foreign Application Priority Data

Feb. 7, 1986 [JP] Japan ..... 61-24062

[51] Int. Cl.[4] ..... C07C 13/00; C10L 1/16

[52] U.S. Cl. ..... 585/7; 585/20; 585/267; 585/268; 585/269

[58] Field of Search ..... 585/7, 70, 267, 268, 585/269

[56] References Cited

U.S. PATENT DOCUMENTS 4,329,529 5/1982 Nambu ..... 585/20

*Primary Examiner*—Curtis R. Davis

*Attorney, Agent, or Firm*—Bucknam and Archer

[57] ABSTRACT

A process for preparing a fluid for traction drive from a fraction containing compounds having at least four aromatic rings is disclosed. The fraction is a by-product produced at the time of the preparation of alpha-methyl-benzylalkylbenzenes by alkylation of at least one compound selected from $C_7$–$C_{10}$ alkylbenzenes with styrene in the presence of an acid catalyst. The process comprises the steps of decomposing the fraction in an atmosphere of hydrogen at a predetermined temperature and pressure, collecting a decomposition product having a boiling range not higher than 450° C. and then subjecting the decomposition product to nuclear hydrogenation at aromatic rings thereof in the presence of a catalyst capable of nuclear hydrogenation.

11 Claims, 3 Drawing Sheets

PROCESS FOR PREPARING A FLUID FOR TRACTION DRIVE

BACKGROUND OF THE INVENTION

1. Field of the Invention

This invention relates to a process for preparing a traction drive fluid which is used in power transmission systems.

2. Description of the Prior Art

As is well known in the art, automobiles have a number of power transmission and speed change gear systems such as transmission, shock absorbers, hydraulic stearing gears, clutches and other fluid actuators. For the transmission of power and speed change through these systems, it is usual to utilize point or line contact traction drive systems. A fluid for traction drive is incessantly supplied to contacting portions of the systems. This fluid serves as a lubricant when no load is applied and permits a friction and heat, which generate under a pressure of 15,000 to 30,000 kg/cm$^2$G on loading, to be reduced or dissipated. As fluids for traction drive, there have been proposed many compounds including various hydrocarbons and oxygen-containing hydrocarbons.

For example, there are known decalin, perhydroanthracene (U.S. Pat. No. 3,411,369), polycyclohexyls (ASLE Transition, 13, 105 (1970), U.S. Pat. No. 3,925,217), bicyclohexyl and dicyclohexylmethane (U.S. Pat. No. 3,440,894), 2,3-dicyclohexylbutane (Japanese Patent Application Laid-Open Gazette No. 46-4510), hydrogenated isobutylene oligomers (Japanese Patent Application Laid-Open Gazette Nos. 46-4766, 47-2164, 47-35661 and 47-2229), hydrogenated alpha-methylstyrene cyclized dimer (Japanese Patent Application Laid-Open Gazette No. 47-2229 and Japanese Patent Publication Gazette No. 47-35763), adamantanes (Japanese Patent Publication Gazette Nos. 48-42067, 48-42068 and 47-35763), esters having a cyclohexyl group (Japanese Patent Application Laid-Open Gazette No. 59-191797), and the like. These prior art traction drive fluids involve various problems such as a difficulty in obtaining inexpensive starting materials for the fluids in large amounts, a difficulty in operation of processes for the preparation of the fluids, a low traction coefficient (rolling friction coefficient) thereof, and the like.

Monsanto's and Sun Oil's Patents and Patent Applications (Japanese Patent Application Laid-Open Gazette No. 47-7664 and Japanese Patent Publication Gazette Nos. 46-339 and 47-35763) describe that polycyclic naphthene compounds are effective as a fluid for traction drive. In fact, a linear alpha-methylstyrene dimer or its analogues each in a nuclearly hydrogenated form are commercially available. However, these hydrogenated compounds leave a problem to be solved from economical and technical standpoints, i.e. it is economically difficult to obtain alpha-methylstyrene, and side reactions are involved in the process of dimerization of alpha-methylstyrene.

There have been studied for use as a fluid for traction drive not only nuclearly hydrogenated products of alpha-methylbenzylalkylbenzenes obtained by alkylating alkylbenzenes such as xylene, toluene and ethylbenzene, which are relatively readily available industrially, with styrene but also nuclearly hydrogenated products of compounds having three aromatic rings. However, they are not necessarily satisfactory in physical properties required for a fluid for traction drive and including, for example, a traction coefficient (rolling friction coefficient), viscosity, pour point, oxidation stability and thermal stability (Japanese Patent Application Laid-Open Gazette Nos. 55-43108 and 55-40726).

SUMMARY OF THE INVENTION

It is therefore an object of the invention to provide a process for preparing a traction drive fluid which can solve the above prior art problems.

It is another object of the invention to provide a process for preparing such a fluid using materials which have never been considered to be of practical value.

It is a further object of the invention to provide a process for preparing a traction drive fluid which meets the required physical properties.

The present inventors made intensive studies in attempts to find a process for preparing a traction drive fluid which satisfies physical properties required for the fluid and can be produced inexpensively. As a result of their studies, it was found that a traction drive fluid having such good properties could be obtained by decomposing a fraction composed mainly of compounds having at least four aromatic rings obtained as a by-product at the time of preparation of alkyl compounds by alkylation of aromatic compounds such as xylene, toluene and ethylbenzene, with styrene, and subjecting a selected fraction of the resulting decomposition products to nuclear hydrogenation of aromatic rings of the selected fraction. The present invention is based on the above finding.

More specifically, the present invention provides a process for preparing a traction drive fluid from a fraction mainly containing compounds having at least four aromatic rings, the fraction being a by-product obtained at the time of preparation of alpha-methylbenzylalkylbenzenes by alkylation of a compound selected from $C_7$–$C_{10}$ alkylbenzenes or a mixture thereof with styrene in the presence of an acid catalyst. The process is characterized by decomposing the fraction in a hydrogen atmosphere at a reaction temperature of from 300° to 500° C. and a hydrogen pressure of from 20 to 200 kg/cm$^2$G, collecting from the thus obtained decomposition products a decomposition product having a boiling range not higher than 450° C. with or without adjusting the viscosity thereof to 10 to 350 centistokes at 40° C. and then subjecting the thus collected decomposition product to nuclear hydrogenation at the aromatic rings thereof in the presence of a catalyst capable of nuclear hydrogenation.

DETAILED DESCRIPTION AND EMBODIMENTS OF THE INVENTION

Figure 1:
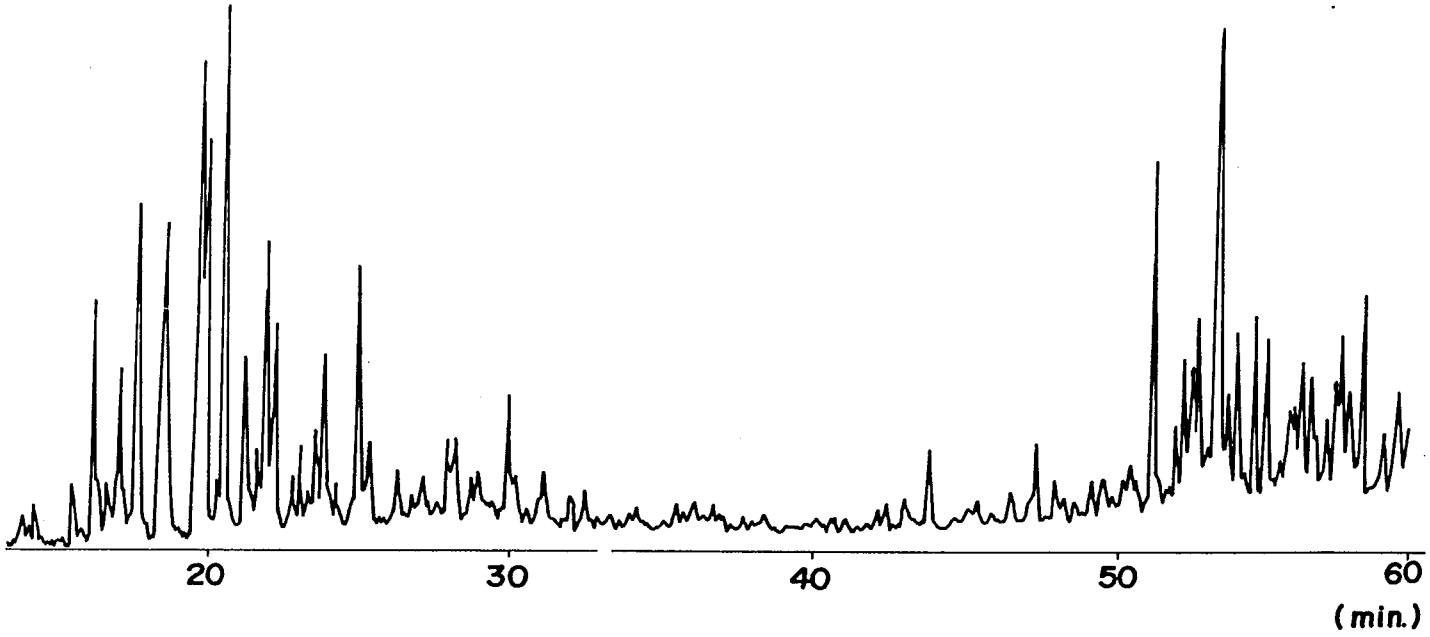
FIG. 1 is a chromatogram showing the results of gas chromatography of nuclearly hydrogenated fractions in Examples 1 and 2.

The starting material used in the process of the invention is a fraction composed mainly of compounds having at least 4 aromatic rings, the fraction being obtained as a by-product upon preparation of alpha-methylbenzylalkylbenzenes by alkylation with styrene, of at least one compound selected from $C_7$–$C_{10}$ alkylbenzenes (e.g. toluene, xylene and/or ethylbenzene being used industrially) in the presence of an acid catalyst such as a mineral acid (e.g. sulfuric acid), a solid acid (e.g. silica and alumina), or the like. The fraction so obtained should preferably contain not less than about 80 wt%, more preferably not less than 99%, of compounds having four or more aromatic rings.

A typical technique of producing as a by-product a fraction mainly containing the compounds with four or more aromatic rings is a process for preparing alpha-methylbenzylalkylbenzenes having two aromatic rings by alkylating at least one compound selected from $C_7$–$C_{10}$ alkylbenzenes with styrene in the presence of a sulfuric acid as the catalyst (Japanese Patent Application Laid-Open Gazette No. 48-97858).

In the practice of the invention, the starting material is decomposed in an atmosphere of hydrogen at a reaction temperature of from 300° to 500° C., preferably from 350° to 440° C. under a reaction pressure of from 20 to 200 kg/cm$^2$G, preferably from 50 to 150 kg/cm$^2$G.

The decomposition reaction may be effected in the presence of a hydrogen-providing solvent. In this case, the hydrogen-providing solvent can itself generate hydrogen, so that it is not always necessary to effect the reaction in an atmosphere of hydrogen but an atmosphere of nitrogen may be sufficient for the reaction. Preferably hydrogen-providing solvents include hydrides of polycyclic aromatic compounds such as tetralin and anthracene. If these solvents are used, the reaction temperature may range from 350° to 450° C. and the reaction pressure may be determined such that a hydrogen-providing solvent can exist as a liquid phase at the reaction temperature. When the hydrogen-providing solvent is used in the decomposition reaction, the reaction proceeds mildly as is different from the case where a catalyst is used. The resultant decomposition product has a chemical structure which differs from the structure of a decomposition product obtained by decomposition in the presence of a catalyst. Such a decomposition product is more likely to be nuclearly hydrogenated with the result that the nuclear hydrogenation reaction proceeds at lower temperatures. Moreover, a higher efficiency of the nuclear hydrogenation can be attained because the hydrogenation reaction proceeds satisfactorily and, thus, the resulting nuclearly hydrogenated product increases in traction coefficient (rolling friction coefficient).

In the practice of the invention, the decomposition reaction may be effected in the presence of a solid catalyst. The solid catalyst is not particularly limited and may be any known catalyst used for hydrogenation of petroleum fractions. For instance, sulfides, oxides and the like of at least one metal element selected from those of the Groups V to VIII of the Periodic Table, preferably at least one metal element selected from nickel, cobalt, molybdenum and tungsten are used after having been carried on inorganic carriers such as alumina, silica, silica/alumina and cation-substituted zeolites. The use of the solid catalyst results in a lower decomposition temperature.

The decomposition product obtained by the above decomposition reaction is subjected to distillation or the like to obtain a fraction containing compounds having 2 to 3 aromatic rings and boiling at not higher than 450° C., preferably 200° to 450° C. and more preferably 300° to 450° C. This fraction should preferably contain not less than 90%, more preferably not less than 95%, of compounds having 2 to 3 aromatic rings.

When the viscosity of the fraction ranges from 10 to 350 cSt., preferably from 20 to 350 cSt. at 40° C., the fraction may be used as it is. If the viscosity is outside the range of from 10 to 250 cSt. at 40° C., the fraction is further subjected to separation into a plurality of sub-fractions including, for example, a sub-fraction boiling at 200° to less than 300° C., a sub-fraction boiling at 300° to less than 400° C. and a sub-fraction boiling at 400° to 450° C. These sub-fractions are mixed together in such mixing ratios that the viscosity of the resulting mixture is in the range of from 10 to 350 cSt. at 40° C. When the boiling range of the fraction exceeds 450° C., it is difficult that the nuclear hydrogenation reaction of the fraction does proceed.

In a case where the viscosity is less than 10 cSt. at 40° C., the resultant nuclearly hydrogenated fraction has a low traction coefficient (rolling friction coefficient) and a low viscosity. On the other hand, with a viscosity over 350 cSt. at 40° C., the resulting nuclearly hydrogenated fraction has inconveniently an excessively high viscosity. In either case, the resulting product becomes poor in practical performance as a traction fluid.

The aromatic rings in the fraction having the above-defined range of viscosity are subjected to nuclear hydrogenation in the presence of a catalyst capable of nuclear hydrogenation. The catalyst for this purpose may be any known catalyst ordinarily used for nuclear hydrogenation of aromatic rings. Such catalysts include nickel, nickel oxide, nickel-diatomaceous earth, Raney nickel, nickel-copper, platinum, platinum oxide, platinum-active carbon, platinum-rhodium, platinum-alumina, platinum-lithium-alumina, rhodium-active carbon, palladium, cobalt, Raney cobalt, ruthenium-active carbon, tungsten sulfide-nickel sulfide-alumina rhodium-alumina, ruthenium-alumina and the like. Of these, rhodium-active carbon and ruthenium-active carbon catalysts are preferred.

The nuclear hydrogenation conditions include a reaction temperature of from 50° to 300° C., preferably from 150° to 280° C. and a pressure of from 30 to 100 kg/cm$^2$G, preferably from 60 to 80 kg/cm$^2$G. The contact time should preferably be sufficient to permit substantially all aromatic rings to disappear either in a batch system or in a continuous system. Although depending on the type of a fraction to be nuclearly hydrogenated and the reaction temperature, the contact time is preferably in the range of from about 120 to about 240 minutes at 250° C. to 280° C. When the reaction temperature exceeds 300° C., dealkylation and/or decomposition undesirably takes place and tar is produced as a by-product. If aromatic rings are partially left unreacted because of their insufficient nuclear hydrogenation, the traction coefficient (rolling friction coefficient) lowers considerably.

The nuclear hydrogenation conditions for aromatic rings in the fraction whose viscosity has been adjusted should be suitably determined such that the resulting degree of nuclear hydrogenation is in the range of not less than 40%, preferably not less than 70%.

When the degree of nuclear hydrogenation is less than 40%, the traction coefficient of the resultant nuclearly hydrogenated product undesirably becomes low.

The degree of nuclear hydrogenation of aromatic rings is calculated from the following equation in which fractional rates of aromatic carbon atoms prior and subsequent to the nuclear hydrogenation are utilized.

$$\text{Degree of nuclear hydrogenation (\%)} = \frac{\left(\begin{array}{c}\text{percent } C_A \text{ value}\\ \text{in a fraction to be}\\ \text{nuclearly hydrogenated}\end{array}\right) - \left(\begin{array}{c}\text{percent } C_A \text{ value}\\ \text{in nuclearly hydro-}\\ \text{genated fraction}\end{array}\right)}{\left(\begin{array}{c}\text{percent } C_A \text{ value in a fraction}\\ \text{to be nuclearly hydrogenated}\end{array}\right)} \times 100$$

in which $C_A$ represents a fractional rate of aromatic carbon atoms.

The traction drive fluid obtained according to the invention has a traction coefficient (rolling friction coefficient) of from 0.072 to 0.096, a viscosity of from 50 to 270 cSt. at 40° C. and a pour point of not higher than −10° C. In addition, the fluid has good oxidation and thermal stabilities.

The reason why the fluid obtained by the process of the invention has a high traction coefficient (rolling friction coefficient) is not clear at the present stage of our investigations. Presumably, it is due to the fact that as compared with a known fluid product obtained by alkylation of $C_7$ to $C_{10}$ alkylbenzenes with styrene and subjecting the resulting alkylated product to nuclear hydrogenation (Japanese Patent Application Laid-Open Gazette No. 55-43108), compounds having two or three aromatic rings are contained in larger amounts in the present decomposition product to be nuclearly hydrogenated. Because different types of aromatic components can be formed in a fraction to be nuclearly hydrogenated depending on the decomposition conditions and/or the selection of viscosity of the fraction, it is possible to provide various desired properties such as traction coefficient and viscosity in the resulting traction drive fluid. Moreover, the starting material used is a by-product on which no importance has been heretofore placed, from which a valuable traction drive fluid is obtained. Thus, the process of the invention is more advantageous in economy than known processes.

The present invention will be better understood by Examples and Comparative examples.

EXAMPLE 1

Decomposition with tetralin and nuclear hydrogenation using a rhodium-active carbon catalyst Both about 200 g of a fraction containing 99% of compounds having at least four aromatic rings, the compounds having been obtained by alkylation of toluene, xylene and ethylbenzene with styrene in the presence of a sulfuric acid catalyst, and about 200 g of tetralin were charged in a one-liter autoclave, followed by charging therein hydrogen at an initial pressure of 100 kg/cm$^2$G and reacting the whole mass at 430° C. for 240 minutes. The resultant decomposition product was subjected to distillation to obtain a fraction boiling at 300° to less than 400° C. and a fraction boiling at 400° to 450° C. Both fractions were mixed in a ratio of 3:2 so that the mixture had a viscosity of about 30 cSt. at 40° C. The mixed fraction was subjected to nuclear hydrogenation under an initial hydrogen pressure of 70 kg/cm$^2$G in the presence of a rhodium-active carbon catalyst at 100° to 200° C. for about 11 hours and then filtered under reduced pressure through a glass filter to remove the catalyst, thereby obtaining a traction drive fluid.

The thus obtained fluid had a traction coefficient of 0.082, a viscosity (40° C.) of 54.46 cSt. and a degree of nuclear hydrogenation of 90.9%.

EXAMPLE 2

Decomposition with tetralin and nuclear hydrogenation with a rhodium-active carbon catalyst The procedure of Example 1 was followed except that nuclear hydrogenation was effected at 200°–250° C. for about 20 hours, thereby to obtain a traction drive fluid.

The thus obtained fluid had a traction coefficient of 0.096, a viscosity (40° C.) of 53.94 cSt. and a degree of nuclear hydrogenation of 97.5%.

EXAMPLE 3

Decomposition with a nickel-diatomaceous earth catalyst and nuclear hydrogenation with a rhodium-active carbon catalyst About 300 g of the same compounds having at least four aromatic rings as described in Example 1 and about 30 g of a nickel-diatomaceous earth catalyst were charged into a one-liter autoclave, followed by charging thereinto hydrogen under an initial hydrogen pressure of 100 kg/cm$^1$G and reaction at 360° C. for 4 hours. The resulting decomposition product was subjected to distillation to obtain a fraction boiling at 300° to less than 400° C. and a fraction boiling at 400° to 450° C. Both fractions were mixed in a ratio of 3:2. The mixed fraction which had a viscosity of 49.93 cSt. at 40° C. was subjected to nuclear hydrogenation in the presence of a rhodium-active carbon catalyst under an initial hydrogen pressure of 70 kg/cm$^2$G at 100° to 200° C. for about 11 hours and then filtered under reduced pressure by the use of a glass filter for removal of the catalyst, thereby obtaining a traction drive fluid.

The thus obtained fluid had a traction coefficient of 0.072, a viscosity (40° C.) of 72.89 cSt. and a degree of nuclear hydrogenation of 44.0%. Although this fluid is inferior in performances to the fluid obtained in Example 1, it is economically advantageous in that, for instance, the production procedure is simple and the decomposition temperature is low.

EXAMPLE 4

Decomposition with a nickel-diatomaceous earth catalyst and nuclear hydrogenation with a rhodium-active carbon catalyst The procedure of Example 3 was followed except that nuclear hydrogenation was affected at 200°–280° C. for about 20 hours, thereby obtaining a traction drive fluid.

The thus obtained fluid had a traction coefficient of 0.081, a viscosity (40° C.) of 72.20 cSt. and a degree of nuclear hydrogenation of 76.4%.

COMPARATIVE EXAMPLE 1

Alpha-methylbenzylalkylbenzenes having two aromatic rings, which were obtained by alkylation of xylene and toluene with styrene, were subjected to nuclear hydrogenation in the presence of a known catalyst capable of nuclear hydrogenation at a reaction temperature of 100° to 180° C. for 4 to 12 hours under a hydrogen pressure of 50 to 80 kg/cm$^2$G.

The resulting product had a traction coefficient of 0.070 and a viscosity of 8.5 cSt. (40° C.).

COMPARATIVE EXAMPLE 2

Compounds having three aromatic rings, which were obtained by alkylation of xylene and toluene with styrene, were subjected to nuclear hydrogenation in the presence of a known catalyst capable of nuclear hydrogenation at a reaction temperature of 100° to 180° C. for 4 to 12 hours under a hydrogen pressure of 50 to 80 kg/cm$^2$G.

The resulting product had a traction coefficient of 0.086 and a viscosity of 1472 cSt. (40° C.).

As will be seen from Comparative Examples 1 and 2, when compounds having two or three aromatic rings obtained by alkylation of xylene and toluene with styrene are used as a starting material to be nuclearly hydrogenated, there will not be obtained a fluid which is excellent in both traction coefficient and viscosity. As will be seen from Examples 1 to 4, however, when compounds having at least four aromatic rings, obtained as by-products by alkylation of xylene, toluene and ethylbenzene with styrene, are decomposed by the use of a hydrogen-providing solvent or a solid catalyst and the resulting fraction containing compounds having two or three aromatic rings is used as a starting material to be nuclearly hydrogenated, the resultant fluid will be excellent in both traction coefficient and viscosity.

Figure 2:
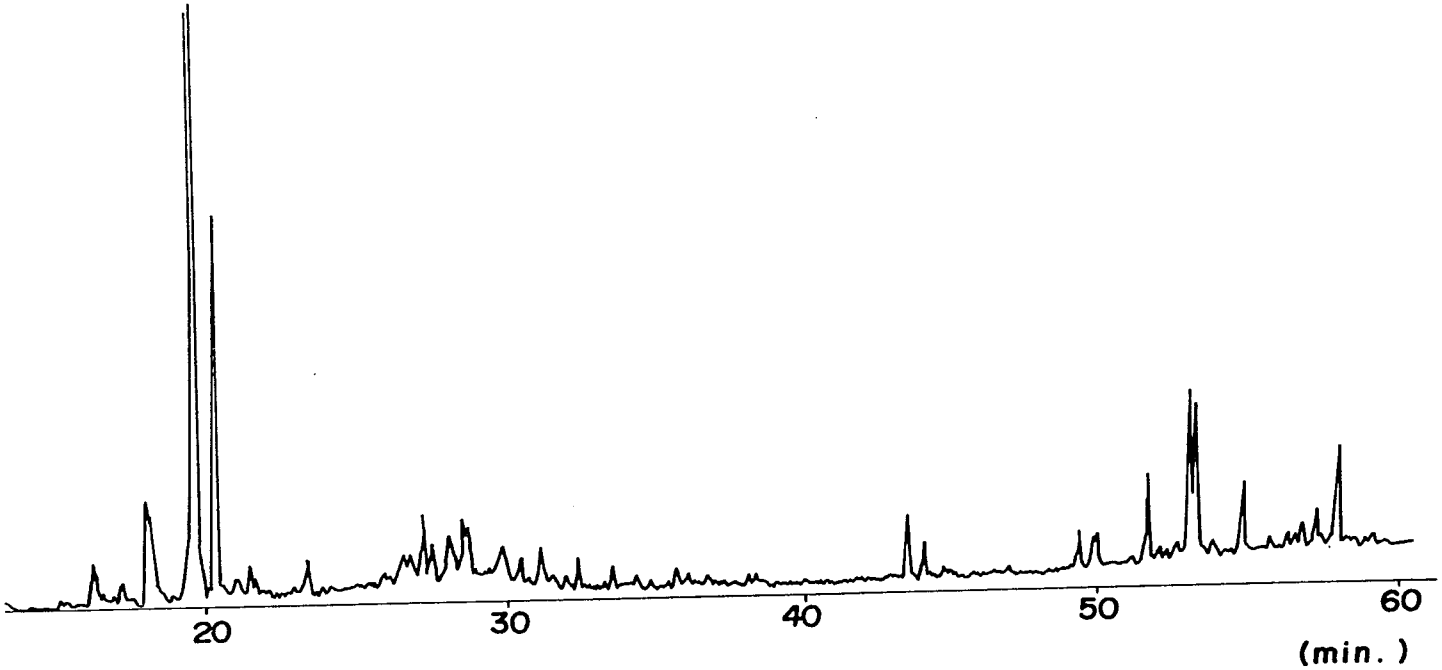
FIG. 2 is a chromatogram showing the results of gas chromatography of nuclearly hydrogenated fractions in Examples 3 and 4.
Figure 4:
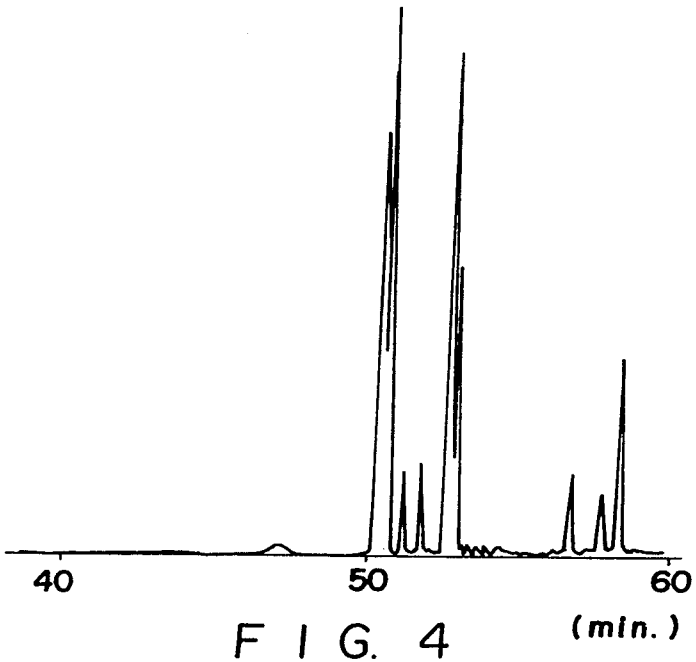
FIG. 4 is a chromatogram showing the results of gas chromatography of a nuclearly hydrogenated fraction in Comparative Example 2.
Figure 3:
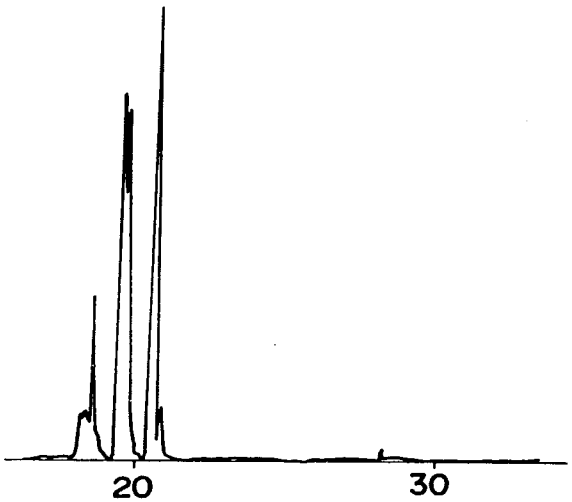
FIG. 3 is a chromatogram showing the results of gas chromatography of a nuclearly hydrogenated fraction in Comparative Example 1.

FIG. 1 shows a chromatogram obtained by gas-chromatography of fractions nuclearly hydrogenated in Examples 1 and 2. Similarly, FIG. 2 shows a chromatogram of fractions nuclearly hydrogenated in Examples 3 and 4. FIG. 3 is a chromatogram of a fraction nuclearly hydrogenated in Comparative Example 1 and FIG. 4 is a chromatogram of a fraction nuclearly hydrogenated in Comparative Example 2.

As will be apparent from the chromatograms, the nuclearly hydrogenated fractions in Examples 1 to 4 are excellent as a traction drive fluid as compared with those in Comparative Examples 1 to 2. The reason for this is considered to be that the fractions to be nuclearly hydrogenated in Examples 1 to 4 contain a larger amount and number of constituents than those in Comparative Examples 1 and 2 although the fractions to be hydrogenated in the Examples contain constituents having two or three aromatic rings as those in the Comparative Examples.

What is claimed is:

1. The process of preparing a traction drive fluid from a fraction containing compounds having at least four aromatic rings, said fraction being produced as a by-product in the preparation of alphamethylbenzylalkylbenzenes by alkylation of at least one compound selected from $C_7$–$C_{10}$ alkylbenzenes with styrene in the presence of an acid catalyst, which consists of the steps of:

(1) decomposing the fraction using a hydrogen-providing solvent in the presence of hydrogen at a reaction temperature of 300°–500° C. and a hydrogen pressure of 20–200 kg/cm$^2$G to obtain decomposition products, (2) collecting decomposition products having a boiling range not higher than 450° C. from the decomposition products obtained in step (1) and then (3) subjecting the decomposition products from step (2) to nuclear hydrogenation at the aromatic rings thereof in the presence of a catalyst capable of nuclear hydrogenation whereby a traction drive fluid having a traction coefficient of from 0.072 to 0.096 and a viscosity of from 50 to 270 cSt. at 40° C. is obtained.

2. A process according to claim 1, wherein the decomposition product so collected in step (2) is adjusted in viscosity to 10–350 cSt. at 40° C. prior to the nuclear hydrogenation thereof.

3. A process according to claim 1, wherein said fraction in step (1) contains not less than about 80% of compounds having at least four aromatic rings.

4. A process according to claim 1, wherein the decomposition reaction in step (1) is effected at a temperature of from 350° to 440° C. under a pressure of from 50 to 150 kg/cm$^2$G.

5. A process according to claim 1, wherein a solid catalyst is additionally used in the decomposition reaction in step (1).

6. A process according to claim 1, wherein said hydrogen-providing solvent is a hydride of a polycyclic aromatic compound and the decomposition reaction is effected at a temperature of from 350° to 450° C. under a pressure sufficient to permit said solvent to be present as a liquid.

7. A process according to claim 1, wherein said decomposition product contains not less than 90% of compounds having two to three aromatic rings.

8. A process according to claim 1, wherein said decomposition product is collected by distillation and comprises a mixture of fractions having different boiling ranges, said mixture being adjusted to have a viscosity ranging from 10 to 350 centistokes at 40° C.

9. A process according to claim 1, wherein said catalyst capable of nuclear hydrogenation in step (2) is rhodium-active carbon or ruthenium-active carbon.

10. A process according to claim 1, wherein the nuclear hydrogenation is effected at a temperature of from 150° to 280° C. under a pressure of from 60 to 80 kg/cm$^2$G.

11. The process according to claim 1 wherein said traction drive fluid has pour point not higher than −10° C.

* * * * *